US011530845B2

(12) United States Patent
Graf et al.

(10) Patent No.: US 11,530,845 B2
(45) Date of Patent: Dec. 20, 2022

(54) CRYOGENIC APPARATUS

(71) Applicant: ICEoxford Limited, Witney (GB)

(72) Inventors: Gergo Graf, Oxford (GB); Paul Kelly, Witney (GB)

(73) Assignee: ICEoxford Limited

( * ) Notice: Subject to any disclaimer, the term of this patent is extended or adjusted under 35 U.S.C. 154(b) by 439 days.

(21) Appl. No.: 16/496,868

(22) PCT Filed: Mar. 21, 2018

(86) PCT No.: PCT/GB2018/050739
§ 371 (c)(1),
(2) Date: Sep. 23, 2019

(87) PCT Pub. No.: WO2018/172772
PCT Pub. Date: Sep. 27, 2018

(65) Prior Publication Data

US 2020/0018524 A1 Jan. 16, 2020

(30) Foreign Application Priority Data

Mar. 22, 2017 (GB) ..... 1704558

(51) Int. Cl.
*F25B 9/10* (2006.01)
*F25B 9/14* (2006.01)
*F25D 19/00* (2006.01)

(52) U.S. Cl.
CPC ..... *F25B 9/14* (2013.01); *F25B 9/10* (2013.01); *F25D 19/006* (2013.01); *F25B 2400/17* (2013.01)

(58) Field of Classification Search
CPC ..... F25B 9/10; F25B 9/14; F25B 2400/17; F25D 19/006
See application file for complete search history.

(56) References Cited

U.S. PATENT DOCUMENTS 5,381,666 A 1/1995 Saho et al.
2010/0113282 A1 5/2010 Kawashima
(Continued)

FOREIGN PATENT DOCUMENTS

JP 2003194428 7/2003

OTHER PUBLICATIONS

International Search Report and Written Opinion for Application No. PCT/GB2018/050739 dated Jun. 22, 2018.

*Primary Examiner* — Nael N Babaa
(74) *Attorney, Agent, or Firm* — Tumey L.L.P.

(57) ABSTRACT

A cryogenic apparatus (10) includes an enclosure (12), a first thermo-mechanical cooler (20) and a second thermo-mechanical cooler (22) which project into the enclosure (12), at least the second thermo-mechanical cooler (22) being a two-stage cooler, and each cooler (20, 22) having a fluid inlet and a fluid outlet for each stage, and a helium gas extraction flow duct (40) which extends into the enclosure (12) and which communicates with a vessel (42) to contain liquid helium within the enclosure (12). There is a first heat exchanger (62) within the gas flow duct (40). A first duct (74) carries cold helium gas from a fluid outlet (73) of the first thermo-mechanical cooler (20) and through the first heat exchanger (62) to the fluid inlet (75) of the second stage of the second thermo-mechanical cooler (22).

15 Claims, 6 Drawing Sheets

(56) References Cited

U.S. PATENT DOCUMENTS

2013/0021032 A1* 1/2013 Heiss ..... G01R 33/31
324/316
2013/0067952 A1* 3/2013 Rl ..... H01F 6/04
62/513

* cited by examiner

CRYOGENIC APPARATUS

The present invention relates to a cryogenic apparatus, that is to say an apparatus for low-temperature refrigeration. Such apparatus may enable a specimen to be cooled to a temperature below 10 K, so measurements may be made on the properties of the specimen at such a cold temperature.

A number of different thermo-mechanical devices are known for achieving such low temperatures, for example using pressure cycling of helium gas. For example this may be achieved using a Stirling cooler, a Joule-Thomson cooler, a pulse tube refrigerator, or a Gifford-McMahon cooler. The last two are suitable for temperatures below about 5 K, to obtain liquid helium. In the case of the Gifford-McMahon cooler, high-pressure helium at a pressure typically between 10 and 30 bar is used as the working fluid, and a cylinder contains a displacer and regenerator. A mechanical valve connects the cylinder to the gas at low pressure and high pressure alternately, and the displacer is moved in synchronisation with the operation of the valve. Gas expansion takes in heat from the environment at one end of the cylinder, so one end of the cylinder may be referred to as a cold head, and is cooled to a low-temperature. However, it is not always convenient to place the specimen directly in contact with the cold head of a thermo-mechanical cooler. A two-stage Gifford-McMahon cooler may be able to cool a specimen to as low as 4 K, but a cooler to reach a lower temperature, and to cool down more quickly, would be advantageous.

According to the present invention there is provided a cryogenic apparatus, the apparatus comprising: an enclosure; a first thermo-mechanical cooler and a second thermo-mechanical cooler which project into the enclosure, at least the second thermo-mechanical cooler being a two-stage cooler, and each cooler having a fluid inlet and a fluid outlet for each stage; a helium gas extraction flow duct which extends into the enclosure and which communicates with a vessel to contain liquid helium within the enclosure; a first heat exchanger within the gas flow duct; wherein the apparatus also comprises a first duct to carry cold helium gas from a fluid outlet of the first thermo-mechanical cooler and through the first heat exchanger to the fluid inlet of the second stage of the second thermo-mechanical cooler, and a second duct to carry liquid helium from the fluid outlet of the second thermo-mechanical cooler into the vessel to contain liquid helium.

In an embodiment the cryogenic apparatus also includes a second heat exchanger within the gas flow duct, the second heat exchanger being closer to the vessel to contain liquid helium than the first heat exchanger, and the second duct carries the liquid helium from the fluid outlet of the second thermo-mechanical cooler through the second heat exchanger to the vessel to contain liquid helium.

During use the enclosure would be evacuated, so heat transfer by convection is suppressed; under the circumstances radiation is a significant cause of heat transfer. The first stage of the second thermo-mechanical cooler may achieve an intermediate cold temperature for example between 40 K and 100 K, for example about 50 K or 60 K. The apparatus may also include a heat shield at the intermediate temperature, the heat shield being in thermal contact with the second thermo-mechanical cooler at a position having the intermediate temperature, and enclosing all the components of the cryogenic apparatus that are intended, in use, to be below that intermediate temperature.

In particular the portion of the gas flow duct that contains the first heat exchanger should be at a temperature well below 50 K during use, so that portion of the gas flow duct is enclosed within the intermediate temperature heat shield. In an embodiment the intermediate temperature heat shield includes an upwardly-extending open-ended tube, and the gas flow duct downstream of the first heat exchanger is supported by, connected to, and in thermal contact with the top end of this open-ended tube.

The first heat exchanger may be enclosed within the gas flow duct, or may define part of the gas flow duct. In the former case the portion of the gas flow duct that encloses the first heat exchanger preferably extends in a different orientation (for example horizontal) to the portion of the gas flow duct communicating with the vessel to contain liquid helium (which may for example be vertical), and also extends in a different orientation to the section of gas flow duct that leads out of the enclosure (which may also be vertical). Clearly there must not be an unobstructed view along the gas flow duct between the vessel to contain liquid helium, and the outside of the enclosure, or there would be the risk of significant radiant heat transfer. There may also be baffles within the portion of the gas flow duct that leads to the outside of the enclosure, to further suppress radiant heat transfer without significantly impeding gas flow.

Alternatively the first heat exchanger may define part of the gas flow duct. It may for example comprise a block of heat-conducting material which defines first channels that constitute part of the gas flow duct, and second channels for the cold helium gas from the fluid outlet of the first thermo-mechanical cooler, so there is good thermal contact between the first and second channels.

A specimen to be cooled down may be placed in the vessel to contain liquid helium, so the specimen is in direct contact with liquid helium during use. Alternatively the vessel to contain liquid helium may be arranged to be in thermal contact with a specimen that is to be cooled down. For example the specimen may be in a chamber that is in thermal contact with the base of the vessel, and this has the benefit that the specimen does not have to fit into the vessel. Such a chamber is desirably enclosed by a heat shield that is at no more than 4 K during use, to minimise radiant heat transfer to the specimen or the chamber. The base of the vessel must be of a good thermal conductor, to maximise heat transfer from the specimen or the chamber to liquid helium within the vessel, and may for example comprise a metal base layer and an upper layer of porous metal, each metal being a good thermal conductor. For example a copper base layer may be combined with an upper layer of porous silver, for example made by sintering; the interface between the two layers may be grooved to increase surface area; and the upper layer may comprise two porous layers, the upper porous layer having greater porosity than the lower porous layer. This enhances the effective surface area for contact between the metal and liquid helium.

In another embodiment the specimen may be supported within a specimen insertion tube, the tube extending to the outside of the enclosure. The specimen insertion tube may extend from the top to near the bottom of the enclosure, so that specimens can be introduced from the top. The vessel to contain liquid helium in this case may surround the specimen insertion tube, for example being an annular chamber. The gas flow duct through which helium gas is extracted may also be annular, at least for part of its length, surrounding the specimen insertion tube; similarly the first heat exchanger may define part of the gas flow duct as described above, and may therefore also be of generally annular form to surround the specimen insertion tube. Preferably the vessel to contain liquid helium and the first heat exchanger are each of annular form surrounding the specimen insertion tube, they are each in thermal contact with the specimen insertion tube, and they are spaced apart along the specimen insertion tube. Spacing them apart helps to reduce the temperature gradient along the length of the specimen insertion tube during operation Such a specimen insertion tube must be provided with baffles to inhibit heat transfer by radiation. The specimen insertion tube may extend below the vessel to contain liquid helium. The specimen insertion tube may contain helium gas which is at atmospheric pressure when the cryogenic apparatus is at ambient temperature. During operation, when the cryogenic apparatus reaches the desired low temperature, which may be less than 2 K, almost all the helium in the specimen insertion tube will condense onto the wall in the vicinity of the vessel that contains liquid helium. Heat transfer within the specimen insertion tube consequently takes place partly by liquid helium droplets falling down the wall, and by convection within the low-pressure helium.

During use of the cryogenic apparatus helium gas is pumped through the first thermo-mechanical cooler, then flowing through the first heat exchanger to the fluid inlet of the second stage of the second thermo-mechanical cooler, and the resulting liquid helium from the fluid outlet of the second thermo-mechanical cooler flows through the second duct into the vessel to contain liquid helium. The helium flow may be controlled by a needle valve in the second duct. The liquid helium in the vessel is caused to evaporate by extracting helium through the gas flow duct, so taking its latent heat from the remaining liquid helium and from the walls of the vessel. Consequently the liquid helium in the vessel may be below 1 K. The fluid path for cooling helium gas and for supplying liquid helium to the vessel, and the gas flow duct, along with the pump, together constitute a helium recirculation circuit, as the extracted helium gas flows back to the pump to be recirculated through this circuit.

At below 2.2 K the liquid helium acts as a superfluid. It is therefore advantageous to provide a sleeve within the vessel that extends a short way up the gas flow duct and then terminates, with a narrow gap between the outside of the sleeve and the inside of the wall of the gas flow duct. Interaction between layers of superfluid on the surfaces on either side of this narrow gap prevents liquid helium from flowing up the wall of the gas flow duct above the top of the sleeve. The gap is preferably between 0.125 and 0.15 mm.

The thermo-mechanical coolers in most cases will produce some vibration, and it is often desirable if vibration of the specimen is inhibited. For this reason the thermo-mechanical coolers may be mechanically linked to the remainder of the apparatus by a vibration-suppressing linkage such as a bellows. This may for example be an edge-welded bellows, of a material such as stainless steel, or bellows of a flexible plastic material. In the preferred embodiment each thermo-mechanical cooler is a Gifford-McMahon cooler.

The invention will now be further and more particularly described, by way of example only, and with reference to the accompanying drawings in which.

Figure 1:
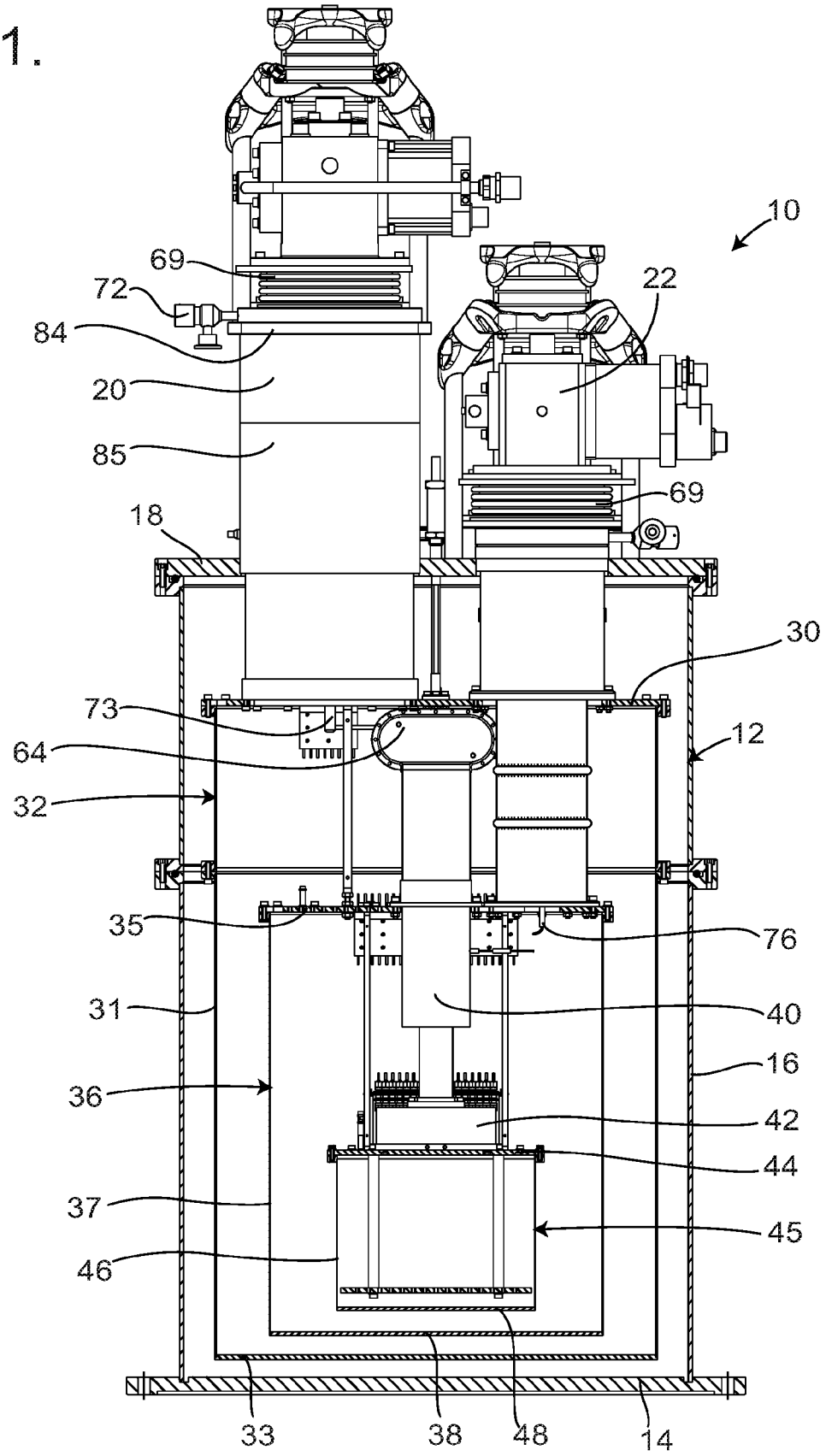
FIG. 1 shows a sectional view in a vertical plane of a cryogenic apparatus of the invention, the apparatus including an enclosure with a top plate, and including two Gifford-McMahon coolers (shown in elevation) and a vessel to contain liquid helium (shown in elevation)
Figure 2:
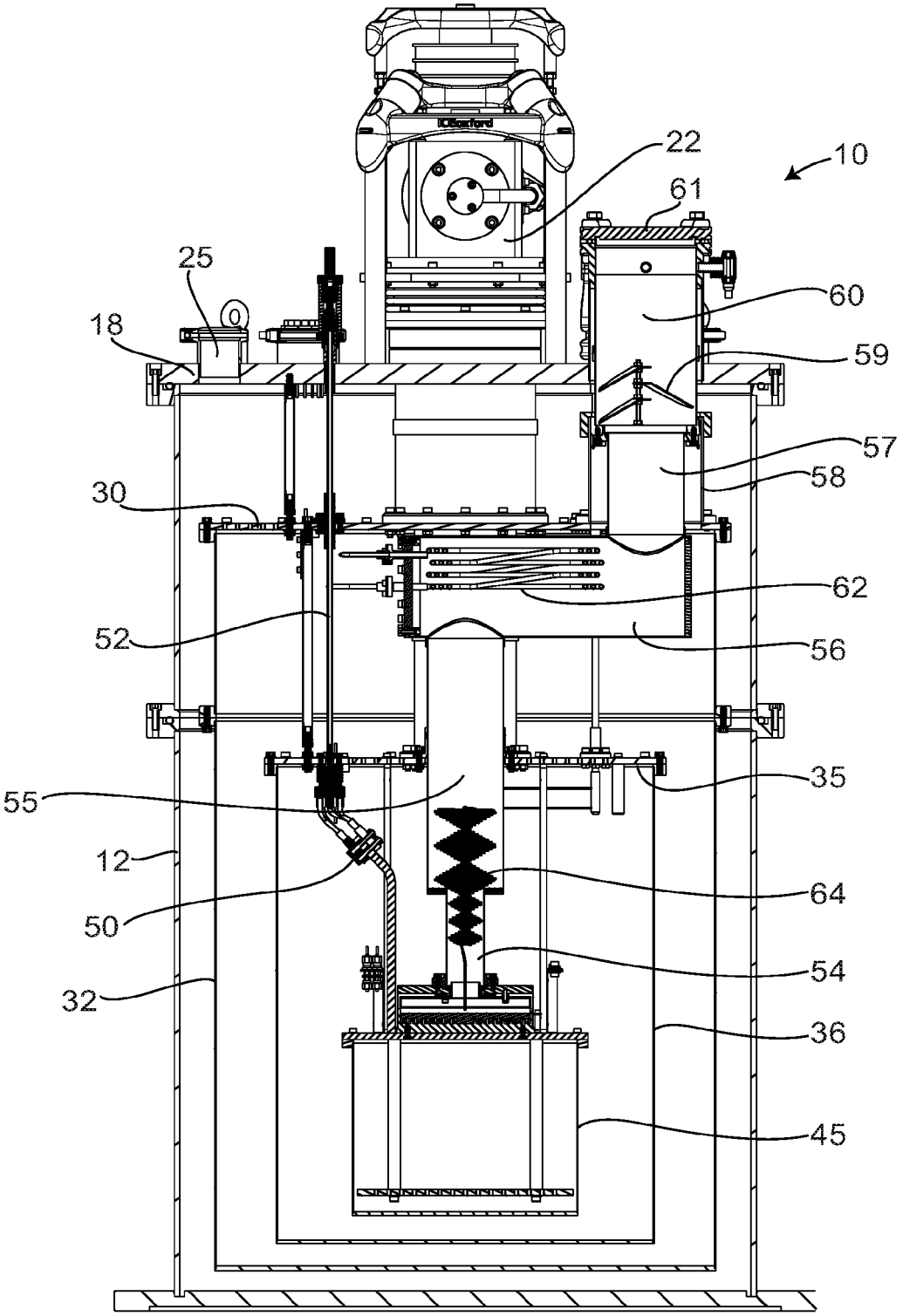
FIG. 2 shows a sectional view in a vertical plane of the apparatus of FIG. 1, the plane of the sectional view being orthogonal to that of FIG. 1.

Referring to FIG. 1, a cryogenic apparatus 10 comprises cylindrical enclosure 12 with a base plate 14, a cylindrical wall 16 and a top plate 18. Mounted on the top plate 18 are a single-stage Gifford-McMahon (G-M) cooler 20 and a two-stage G-M cooler 22. Referring also to FIG. 2, the top plate 18 is also provided with a port 25 so the enclosure 12 can be evacuated.

Referring again to FIG. 1, within the enclosure 12 the lower end of the first stage of the two-stage G-M cooler 22 is in thermal contact with a copper plate 30 which forms part of a cylindrical intermediate-temperature shield 32 with a thin cylindrical wall 31 and a base plate 33, the intermediate-temperature shield 32 being spaced away from and enclosed within the enclosure 12. Similarly, the lower end of the second stage of the two-stage G-M cooler 22 is in thermal contact with a smaller copper plate 35 which forms part of a cylindrical low-temperature shield 36 with a thin cylindrical wall 37 and a base plate 38, the low-temperature shield 36 being spaced away from and enclosed within the intermediate-temperature shield 32. In use the low temperature shield 36 is typically at about 4 K. A gas flow duct 40 extends coaxially within the low-temperature shield 36, and leads to a cylindrical vessel 42 which in use contains liquid helium; this vessel 42 is in thermal contact with a copper support plate 44 which forms part of a cylindrical operating-temperature shield 45 with a cylindrical wall 46 and a base plate 48. The operating-temperature shield 45 is typically at about 1 K during use. (The bottom part of the gas flow duct 40 and the cylindrical vessel 42 are shown in elevation in FIG. 1.)

The copper plate 30, the smaller copper plate 35, and the periphery of the copper support plate 44 are all perforated, so that when the enclosure 12 is evacuated, the thermal shields 45, 36 and 32 are also evacuated. To inhibit radiant heat transfer through the perforations, the perforations are covered with aluminium foil (not shown).

Referring now to FIG. 2, the smaller copper plate 35 is linked to the copper support plate 44 by a thermal switch 50, so that when operation is started the copper support plate 44 can be held in thermal contact with the smaller copper plate 35. The thermal switch 50 can be actuated by a control rod 52 from above the top plate 18, in order to disconnect the copper support plate 44 from the smaller copper plate 35 once the smaller copper plate 35 has been cooled to about 4 K.

In use a specimen to be cooled is mounted within the operating-temperature shield 45, usually being mounted on the underside of the support plate 44. It is cooled by heat conduction through the support plate to helium within the cylindrical vessel 42.

The gas flow duct 40 consists of a narrow cylindrical tube 54 which communicates with the cylindrical vessel 42 at its bottom end, and which at its top end is joined to a cylindrical tube 55 of wider diameter. The cylindrical tubes 54 and 55 are coaxial and extend vertically. The top end of the cylindrical tube 55 is joined to a horizontally-extending cylindrical casing 56 of larger diameter near one end of the casing 56, mounted below the copper plate 30. A cylindrical outlet tube 57 extends vertically and is connected to the cylindrical casing 56 near its other end. The cylindrical outlet tube 57 passes through a circular aperture in the copper plate 30 and is connected to the top end of a tubular sleeve 58 which is mounted on the copper plate 30. The outlet tube 57 communicates with a cylindrical outlet duct 60 which extends above the tubular sleeve 60 and through the top plate 18, and there are staggered baffles 59 in the outlet duct 60 to inhibit heat transfer by radiation. The top end of the outlet duct 60, which constitutes the top end of the gas flow duct 40, is shown as being blocked by a blocking plate 61. This blocking plate 61 must be removed to enable gas to flow along the gas flow duct 40.

A first heat exchange tube 62 is mounted within the cylindrical casing 56. A second heat exchange tube 64 is mounted within the cylindrical tubes 54 and 55, following a zigzag path, and with an end portion that extends to just above the bottom of the cylindrical vessel 42.

Figure 3:
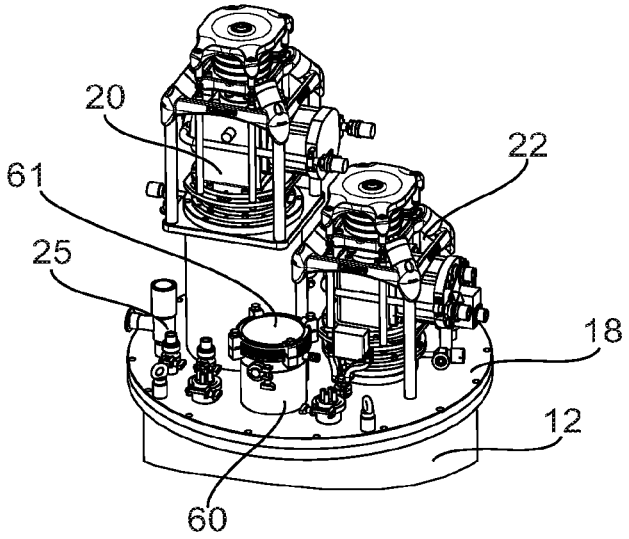
FIG. 3 shows a perspective view of the apparatus of FIG. 1, showing only showing the apparatus above the top plate.

Referring now to FIG. 3, this shows the G-M coolers 20 and 22 mounted on the top plate 18, and the gas outlet duct 60, and also shows the blocking plate 61.

Figure 6:
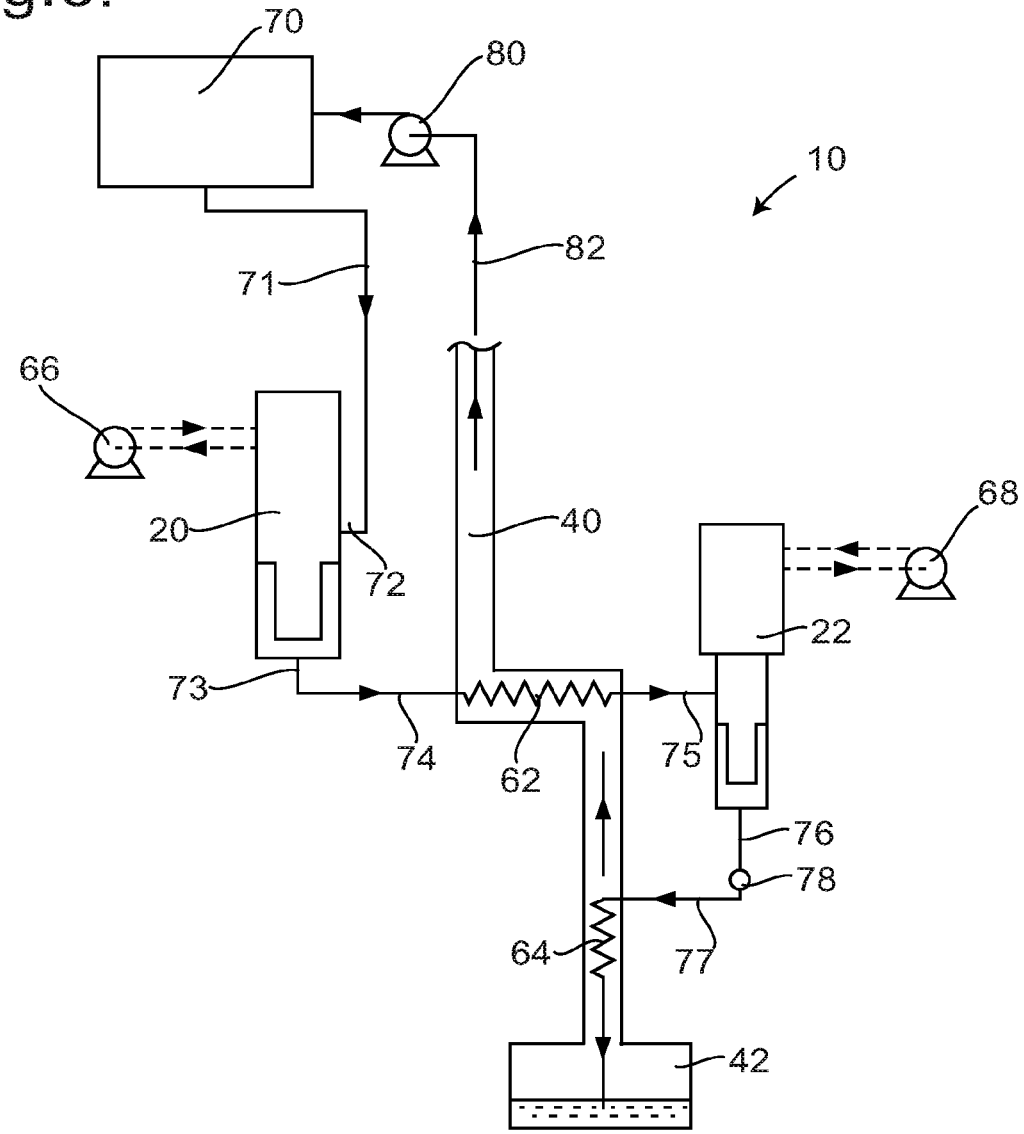
FIG. 6 shows a schematic flow diagram of the cryogenic apparatus of FIG. 1.

Referring now to FIG. 6, this shows the flow paths within the cryogenic apparatus 10 schematically. The thermo-mechanical coolers 20 and 22 in this embodiment are Gifford-McMahon (G-M) coolers which use high-pressure helium at a pressure typically between 10 bar and 30 bar as the working fluid, in closed circuits. The working fluid is provided by external compressors 66 and 68 respectively, the flow paths for the working fluid being shown in broken lines. As previously mentioned, each stage of the G-M cooler 20 or 22 includes a cylinder with a movable displacer and a rotary valve to connect the cylinder alternately to high pressure and low pressure, and a mechanism to move the displacer (or displacers) in synchronisation with the movement of the valve. Such coolers are commercially-available products (e.g. from Sumitomo Heavy Industries) and their details are not the subject of the present invention. Since the thermo-mechanical coolers 20 and 22 include moving parts, which operate typically at a frequency of about 1 Hz, the components that are subject to this oscillation may be separated from the items connected to the top plate 18, for example by connecting the thermo-mechanical coolers 20 and 22 to a support frame by a vibration-suppressing rubber mounts, and also by the provision of a vibration-suppressing stainless steel edge-welded bellows 69 (see FIG. 1).

The cooling of a specimen is brought about by circulating helium through the cryogenic apparatus 10. Helium gas is stored in a reservoir 70 typically at a pressure of about 100 kPa (about 1 bar) or less, and at about ambient temperature. The helium gas flows through a duct 71 to an inlet 72 of the single stage G-M cooler 20; this cools the gas to about 15 K. The gas then flows from the outlet 73 of the G-M cooler 20 through a duct 74, through the first heat exchanger tube 62, cooling to about 9 K, and so into an inlet 75 of the second stage of the G-M cooler 22. The second stage of the G-M cooler 22 cools the helium to about 4 K; so liquid helium emerges from the outlet 76. The liquid helium from the outlet 76 flows through a duct 77 in which is a needle valve 78 to control the outflow of liquid helium. The duct 77 leads to the second heat exchanger tube 64 and so into the cylindrical vessel 42. Liquid helium typically at about 2 K is thus fed into the cylindrical vessel 42.

This helium flow is brought about by a pump 80 which extracts helium gas from the gas flow duct 40 through a duct 82 connected to the top of the gas flow duct 40 after removal of the blocking plate 61, and supplies it to the reservoir 70. The pressure at the exit from the gas flow duct 40 may for example be less than 10 Pa (about 0.1 mbar), so that the liquid helium in the cylindrical vessel 42 evaporates at below its normal boiling point, taking its latent heat from the surroundings, and in particular from the copper support plate 44 and hence from the specimen. By way of example the liquid helium in the vessel 42 may be at 1 K.

Figure 4:
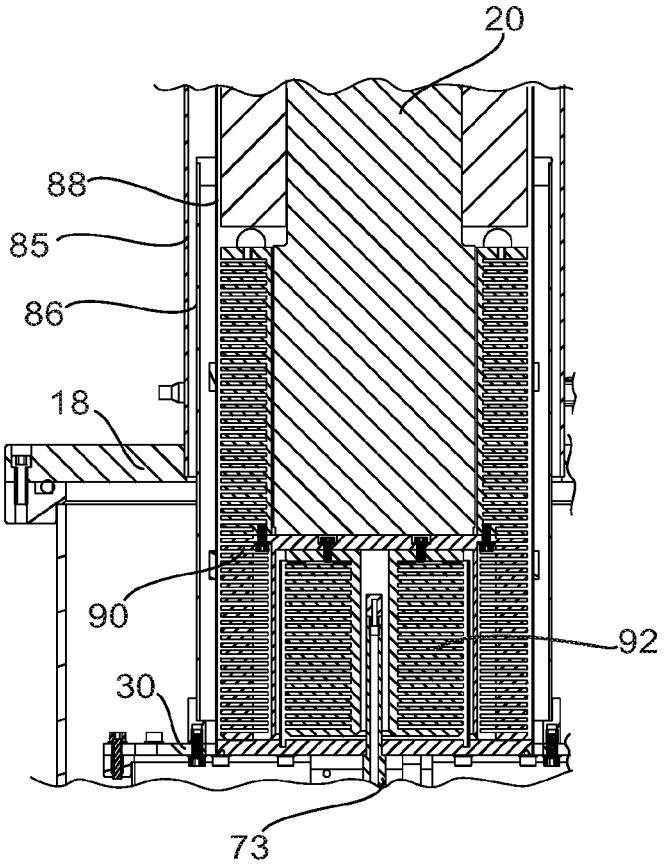
FIG. 4 shows an expanded sectional view of the lower part of one of the Gifford-McMahon coolers in the cryogenic apparatus of FIG. 1.

It will be appreciated that good thermal contact is required between the flowing gas and the cooling ends of the G-M coolers 20, 22. One way this can be achieved will now be described in relation to the G-M cooler 20. Referring to FIG. 1, the G-M cooler 20 is connected to a flange 84 at the top end of a stainless steel tube 85 mounted on the top plate 18 such that the tube 85 forms part of the enclosure 12 and is evacuated in use. The gas inlet 72 is just above this flange 84. Referring now to FIG. 4, a thin stainless steel sleeve 86 is mounted on the copper plate 30 and extends upwardly concentric with the tube 85 to surround the lower part of the G-M cooler 20; in use this sleeve 86 is therefore at the intermediate temperature, for example of 50 K, and so acts as a thermal barrier. The lower end of the G-M cooler 20 can therefore be at a lower temperature than the copper plate 30 of the intermediate shield 32.

A thin-walled stainless steel tube 88 is connected at its top end to the flange 84, and at its bottom end is connected to the copper plate 30, concentrically within the sleeve 86. The lower part of the G-M cooler 20 can therefore be removed from this steel tube 88, if necessary, by disconnecting it from the flange 84. Grooved copper blocks 90 and 92 are bolted onto the bottom part of the G-M cooler 20 so that they are in good thermal contact with the portion of the G-M cooler 20 from which heat is extracted during operation. The gas inlet 72 feeds the helium gas into the circumferential gap between the G-M cooler 20 and the steel tube 88, so the gas flows in intimate contact with the surface of the copper blocks 90 and 92 before reaching the outlet 73.

A similar technique is utilised in the G-M cooler 22, using grooved copper blocks bolted to the G-M cooler 22 to ensure good thermal contact; and again the gas is arranged to flow in intimate contact with the surfaces of these copper blocks.

Figure 5:
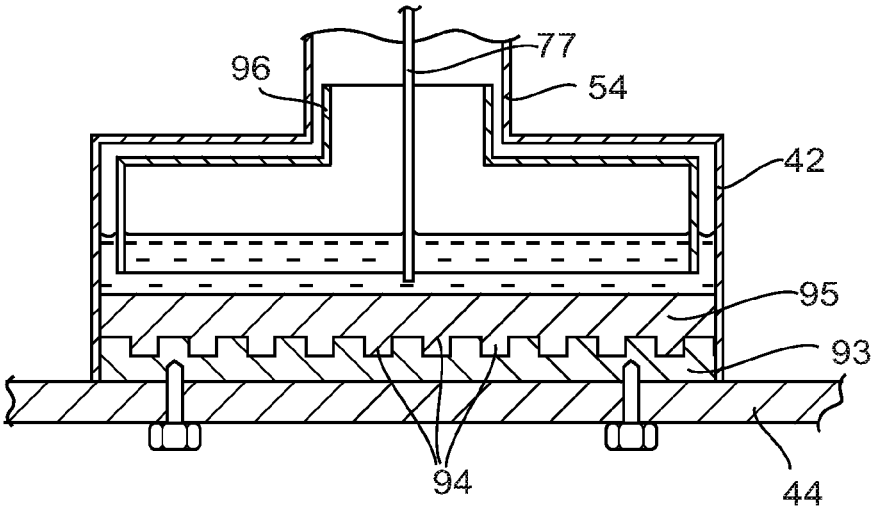
FIG. 5 shows an expanded sectional view of the vessel to contain liquid helium of FIG. 1.

Another consideration to ensure effective cooling of the specimen is to ensure good thermal contact between the liquid helium and the copper support plate 44. Referring now to FIG. 5, the copper support plate 44 is bolted onto a copper plate 93 which forms the bottom of the cylindrical vessel 42, and the top surface of the copper plate 93 is provided with grooves 94, and is covered with a layer 95 of porous silver, whose porosity is graded so an upper portion of the layer 95 has greater porosity than a lower portion. This enhances the effective surface area for heat transfer to the liquid helium, and consequently heat removal from the specimen. The bolted connection between the copper support plate 44 and the copper plate 93 has been found to provide good heat transfer, and makes it possible to completely remove the operating-temperature shield 45 if the user wishes to do so.

At below 2.2 K the liquid helium acts as a superfluid. A sleeve 96 is therefore provided within the vessel 42, starting below the normal liquid level for helium and extending a short way up the cylindrical tube 54 and then terminating, with a narrow gap between the outside of the sleeve 96 and the inside of the wall of the cylindrical tube 54. The gap may be of width 0.125 mm, so that interaction between layers of superfluid on the surfaces on either side of this narrow gap prevents liquid helium from flowing up the wall of the cylindrical tube 54 above the top of the sleeve 96.

It has been found that the cryogenic apparatus 10 can cool the copper support plate 44 and with it the specimen to less than 1 K, for example providing a continuous cooling power of 350 mW at that temperature to a specimen attached to the underside of the copper support plate 44. It will be appreciated that the larger the heat load on the copper support plate 44, the more helium will evaporate from the vessel 42, and so the greater will be the cooling power provided by the first heat exchanger tube 62 and the second heat exchanger tube 64 from heat exchange with the flowing helium gas.

It will be appreciated that the above description is by way of example only, and that the cryogenic apparatus 10 may be modified in a variety of ways while remaining within the scope of the invention, which is as defined by the claims. By way of example the cylindrical casing 56 which encloses the first heat exchanger tube 62 might instead be inclined from the horizontal, or might indeed be vertical, as long as the overall shape of the gas flow duct 40 is such as to prevent radiant heat transfer between items outside the enclosure 12 and the contents of the cylindrical vessel 42. As another alternative, the copper plate 93 forming the bottom of the cylindrical vessel 42 might be integral with the copper support plate 44. Furthermore one or both of the plates 93 and 44 might be of silver, as this is also a good heat conductor, although more expensive than copper. In another alternative the specimen might be placed within the cylindrical vessel 42 so it is in direct contact with liquid helium during operation, and in this case the operating-temperature shield 45 might be omitted.

Figure 7:
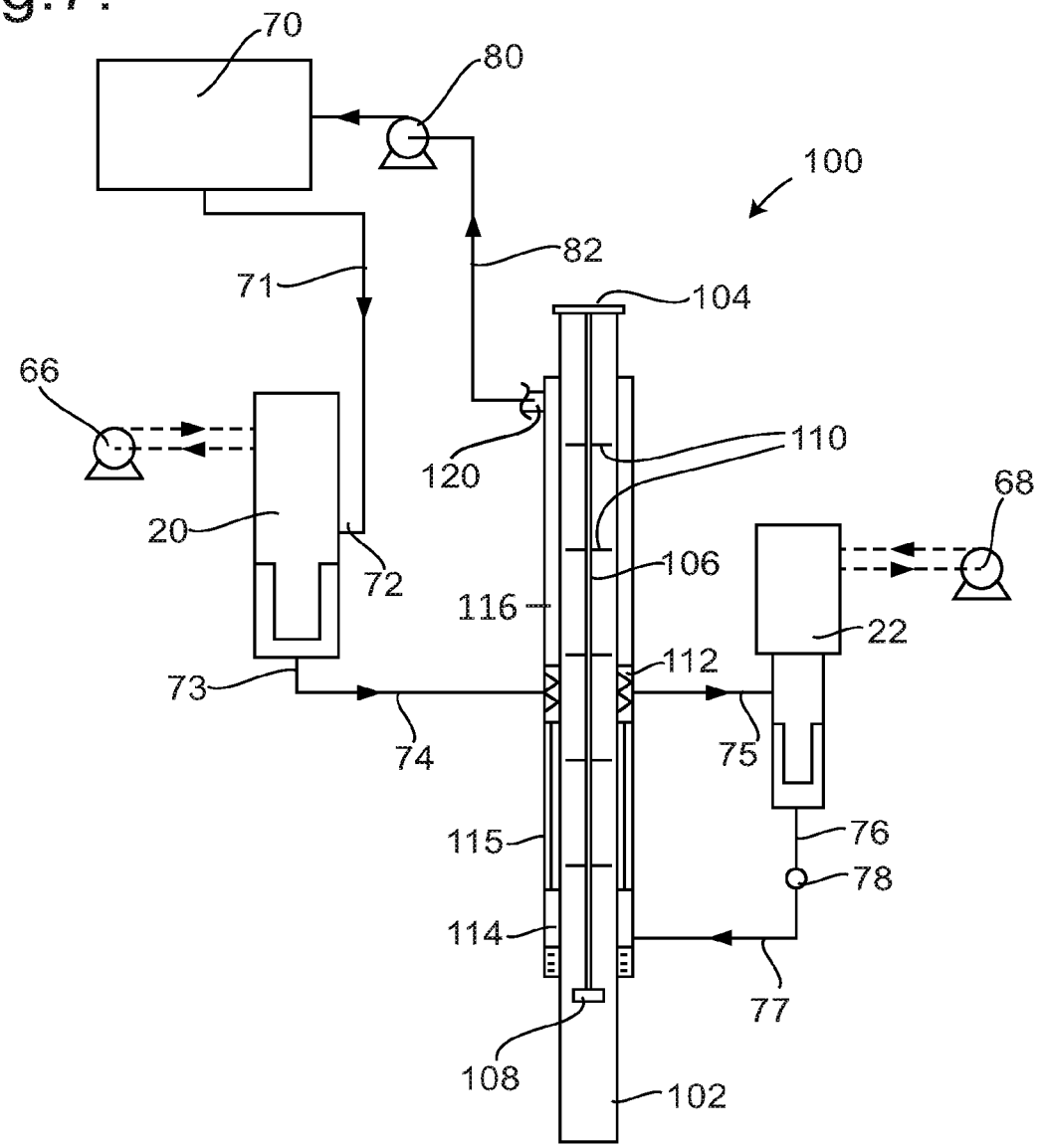
FIG. 7 shows a schematic flow diagram of an alternative cryogenic apparatus of the invention.

Referring now to FIG. 7 there is shown a schematic flow diagram of an alternative cryogenic apparatus 100 which has several features in common with the apparatus 10, identical features being referred to by the same reference numerals. The apparatus 100 includes thermo-mechanical coolers 20 and 22 which are Gifford-McMahon (G-M) coolers that use high-pressure helium at a pressure typically between 10 bar and 30 bar as their working fluid, in closed circuits. The working fluid is provided by external compressors 66 and 68 respectively, the flow paths for the working fluid being shown in broken lines.

The apparatus 100 includes an enclosure 12 with a cylindrical wall 16 and a top plate 18, the G-M coolers 20 and 22 being mounted on the top plate 18. Within the enclosure 12 the lower end of the first stage of the two-stage G-M cooler 22 is in thermal contact with a copper plate 30 which forms part of a cylindrical intermediate-temperature shield 32. These features (not shown in FIG. 7) are equivalent to those shown in FIG. 1. In addition a specimen insertion tube 102 extends through the top plate 18 to near the bottom of the enclosure 12. The specimen insertion tube 102 has a removable lid 104 from which extends a support rod 106 of a material of poor thermal conductivity. At the bottom end of the support rod 106 is a specimen support plate 108 to which a specimen can be mounted. Multiple baffles 110 are mounted along the length of the support rod 106 to inhibit heat transfer by radiation. After insertion of the specimen into the specimen insertion tube 102, the specimen insertion tube 102 would be filled with helium gas at ambient temperature and pressure, and then sealed.

The cooling of a specimen is brought about by circulating helium through the cryogenic apparatus 100. As in the cryogenic apparatus 10, the helium that is circulated to bring about cooling of a specimen is in a different circuit to the pressurised helium that is the working fluid of the G-M coolers 20 and 22. Helium gas is stored in a reservoir 70 typically at a pressure of about 100 kPa (about 1 bar) or less, and at about ambient temperature. The helium gas flows through a duct 71 to an inlet 72 of the single stage G-M cooler 20; this cools the gas to about 15 K. The gas then flows from the outlet 73 of the G-M cooler 20 through a duct 74, through a first heat exchanger 112, cooling to about 9 K, and so into an inlet 75 of the second stage of the G-M cooler 22. The second stage of the G-M cooler 22 cools the helium to about 4 K, so liquid helium emerges from the outlet 76. The liquid helium from the outlet 76 flows through a duct 77 in which is a needle valve 78 to control the outflow of liquid helium. The duct 77 leads to an annular vessel 114. Liquid helium typically at about 4 K is thus fed into the annular vessel 114.

The annular vessel 114 and the first heat exchanger 112 are spaced apart along the specimen insertion tube 102, the first heat exchanger 112 being further up, but are both mounted so as to surround the specimen insertion tube 102. Eight narrow stainless steel tubes 115 allow outflowing helium gas to flow from the annular vessel 114 to the first heat exchanger 112; and above the first heat exchanger 112 the outflowing helium gas can flow through an annular duct 116 surrounding the specimen insertion tube 102, leading to a gas outlet port 120.

The gas outlet port 120 is connected to a pump 80. Hence the helium flow is brought about by the pump 80 which extracts helium gas from the annular duct 116, and so from the annular vessel 114, and supplies it to the reservoir 70. The pressure at the exit from the annular duct 116 may for example be less than 10 Pa (about 0.1 mbar), so that the liquid helium in the annular vessel 114 evaporates at below its normal boiling point, taking its latent heat from the surroundings, and in particular from the wall of the specimen support tube 102. By way of example the liquid helium in the annular vessel 114 may be at 1 K. Heat transfer between the specimen and the wall of the specimen support tube 102 takes place by convection of low pressure helium gas within the specimen support tube 102.

Figure 8:
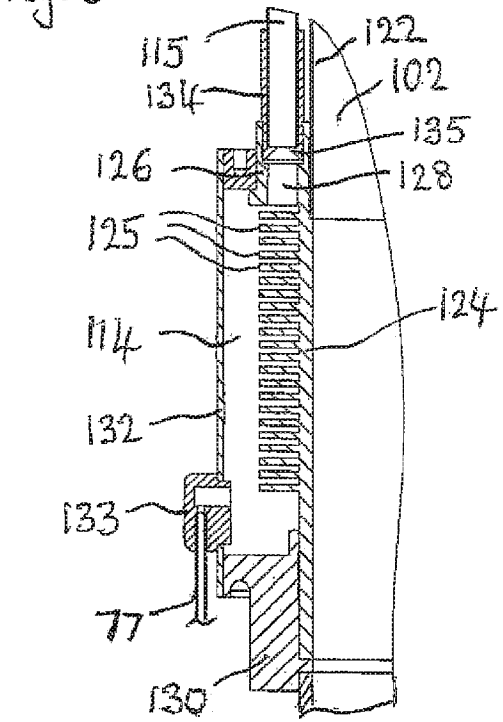
FIG. 8 shows a sectional view of the vessel for liquid helium of the apparatus of FIG. 7.

Referring now to FIG. 8, this shows the vessel 114 to contain liquid helium to a larger scale, showing the left-hand side in section. Most of the length of the specimen insertion tube 102 is defined by lengths of thin-walled stainless steel tube 122, but within the vessel 114 the specimen insertion tube 102 is defined by a copper tube 124 with a thicker wall and multiple thin projecting circumferential fins 125 around its outer surface, and at the top end the tube 124 defines an outward-projecting flange 126 through which are eight holes 128. At the lower end is attached a base flange 130. A stainless steel tube 132 is welded to the flange 126 and to the base flange 130 so as to define an annular chamber. A bush 133 is mounted in the tube 132, to which the capillary tube 77 is connected. A tubular bush 134 is mounted in the top end of each hole 128, into which is fitted the bottom end of one of the eight narrow tubes 115. The bottom end of the tubular bush 134 defines a sharp-edged aperture 135.

During operation liquid helium is introduced through the capillary tube 77 into the annular chamber of the vessel 114 where it boils vigorously, so its temperature drops to about 1 K. The fins 125 ensure good heat transfer from the helium liquid and vapour in the annular chamber into the copper tube 124 and hence into the contents of the specimen insertion tube 102. The resulting helium gas flows out through the holes 128 and so through the eight narrow tubes 115. The sharp-edged apertures 135 prevent superfluid liquid helium from flowing into the tubes 115.

Figure 9:
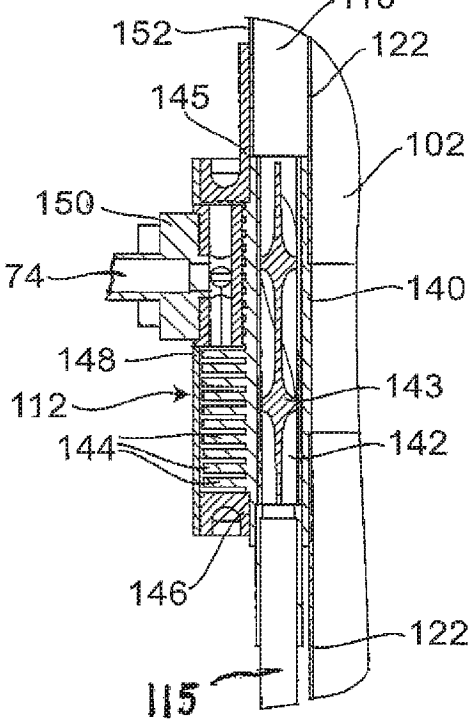
FIG. 9 shows a sectional view of the first heat exchanger of the apparatus of FIG. 7.

Referring now to FIG. 9, this shows a sectional view of the left-hand side of the first heat exchanger 112 to a larger scale than that of FIG. 7. Within the first heat exchanger 112 the specimen insertion tube 102 is defined by a thick-walled copper tube 140 connected between lengths of thin-walled stainless steel tube 122. The thick-walled copper tube 140 defines eight axial holes 142 spaced apart around its circumference, and multiple circumferential flanges 144 around its outer surface. Short sections at each end of the copper tube 140 have no flanges 144, and are welded to respective annular weld flanges 145 and 146 which project radially slightly further than the outer edges of the flanges 144, the upper weld flange 145 projecting above the top of the copper tube 140. A stainless steel tube 148 is welded to the outer surfaces of the annular weld flanges 145 and 146 to define an outer wall of the heat exchanger 112, so there is a small gap between the outer edges of the flanges 144 and the inner surface of the steel tube 148. At the top left of the heat exchanger 112 (as shown) the flanges 144 and the tube 148 are cut away to accommodate a fluid distribution boss 150 to which the duct 74 connects; an identical fluid distribution boss 150 (not shown) is provided at the bottom right of the heat exchanger 112, and is connected to the outlet part of the duct 74.

Each axial hole 142 defines a thread on its surface, and locates a twisted baffle 143. The tubes 115 seal into the bottoms of the axial holes 142. A thin-walled outer stainless steel tube 152 surrounds the upper length of stainless steel tube 122 so as to define the annular duct 116, being welded to the projecting part of the upper weld flange 145.

Hence in operation, outflowing helium gas from the tubes 115 flows through each hole 142. The threaded surface and the twisted baffle 143 ensure good heat transfer to the thick copper tube 140 so that the portion of the specimen insertion tube 102 defined by the copper tube 140 is held at below 10 K, for example at 7 K. The helium gas at about 15 K from the G-M cooler 20 flows through the duct 74 into the fluid distribution boss 150 on the left hand side (as shown), and so the helium gas is distributed to flow over the surfaces of the multiple flanges 144, thereby being cooled to about 9 K, to emerge from the fluid distribution boss 150 (not shown) on the right-hand side.

Figure 10:
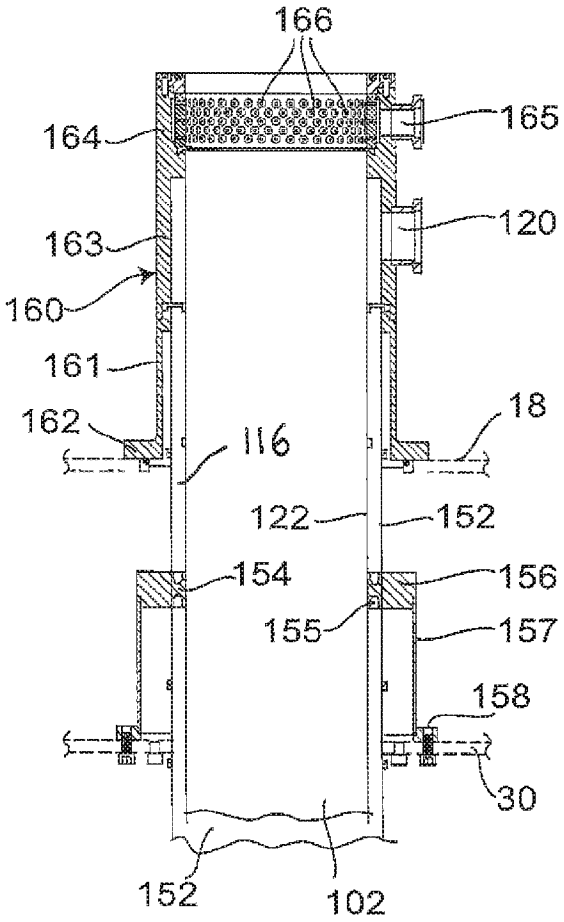
FIG. 10 shows a sectional view of an upper portion of the specimen insertion tube of the apparatus of FIG. 7.

Referring now to FIG. 10, this shows the portion of the specimen support tube 102 above the first heat exchanger 112, to a smaller scale than that of FIG. 9. The thin-walled outer stainless steel tube 152 and the concentric length of stainless steel tube 122 that define the annular duct 116 extend through an aperture in the copper plate 30. About 100 mm above the copper plate 30 is a copper ring 154 that locates within the annular duct 116, and which defines multiple holes 155 between its bottom and top surfaces, the holes 155 being inclined relative to the longitudinal axis of the specimen support tube 102. The copper ring 154 is connected to a close-fitting outer copper ring 156, which is supported by a thin copper tube 158 whose lower end has a flange 159 connected to the copper plate 30 (indicated in broken lines).

Above the copper ring 154, the outer stainless steel tube 152 and the concentric length of stainless steel tube 122 extend within a stainless steel sleeve 160 with a stepped bore. The lowermost portion 161 of the stainless steel sleeve 160 has a bore larger than the diameter of the outer steel tube 152, and defines a flange 162 which is connected to the top plate 18 (indicated in broken lines). The intermediate portion 163 of the stainless steel sleeve 160 has a bore equal to the diameter of the outer stainless steel tube 152, so that the top portion of the annular duct 116 is defined by the bore of the intermediate portion 163 of the stainless steel sleeve 160; the intermediate portion 163 of the stainless steel sleeve 160 also defines the outlet port 120. The topmost portion 164 of the sleeve 160 has a bore equal to the internal diameter of the specimen support tube 102, so that it closes the top end of the annular duct 116, and also defines a port 165. Helium gas can be introduced through the port 165 to emerge through multiple ports 166 into the specimen support tube 102.

In operation it will be appreciated that the copper ring 154 is held at a temperature of about 50 K because it is within the cylindrical enclosure 12 and thermally connected to the copper plate 30, thereby holding that portion of the specimen support tube 102 at about 50 K. The inclined holes 155 through the copper ring 154 allow the through-flow of helium gas, but inhibit heat transfer by radiation along the annular duct 116. Hence as described above, pump 80 causes the helium gas to flow to the top of the annular duct 116 to emerge through the port 120.

During operation, when the annular chamber of the vessel 114 is at about 1 K, the specimen attached to the support plate 108 and indeed the adjacent portion of the specimen insertion tube 102 is all cooled to about 1 K, heat transfer within the specimen insertion tube 102 occurring due to convection in the remaining low pressure helium. The apparatus 100 may incorporate additional features, for example it may include a low-temperature thermal shield arranged to be cooled by the second stage of the G-M cooler 22; furthermore it may include an operating-temperature thermal shield in thermal contact with the vessel 114 that contains liquid helium. The apparatus may include other components, for example a superconducting electromagnet to enable the specimen to be subjected to a magnetic field. The apparatus may also include sensors for a variety of parameters such as temperature and pressure within the helium recirculation path; and sensors for properties of the specimen.

Other variations and modifications will be apparent to the skilled person. Such variations and modifications may involve equivalent and other features that are already known and which may be used instead of, or in addition to, features described herein. Features that are described in the context of separate embodiments may be provided in combination in a single embodiment. Conversely, features that are described in the context of a single embodiment may also be provided separately or in any suitable sub-combination.

It should be noted that the term "comprising" does not exclude other elements or steps, the term "a" or "an" does not exclude a plurality, a single feature may fulfil the functions of several features recited in the claims and reference signs in the claims shall not be construed as limiting the scope of the claims. It should also be noted that the Figures are not necessarily to scale; emphasis instead generally being placed upon illustrating the principles of the present invention.

What is claimed is:

1. A cryogenic apparatus, the apparatus comprising:

an enclosure;

a first thermo-mechanical cooler and a second thermo-mechanical cooler which project into the enclosure, at least the second thermo-mechanical cooler being a two-stage cooler, and each cooler having a fluid inlet and a fluid outlet for each stage;

a helium gas extraction flow duct which extends into the enclosure and which communicates with a vessel to contain liquid helium within the enclosure;

a first heat exchanger within the helium gas extraction flow duct; wherein the apparatus also comprises a first duct to carry helium gas from the fluid outlet of the first thermo-mechanical cooler and through the first heat exchanger to the fluid inlet of the second stage of the second thermo-mechanical cooler, and a second duct to carry liquid helium from the fluid outlet of the second stage of the second thermo-mechanical cooler into the vessel to contain liquid helium.

2. The apparatus as claimed in claim 1 also comprising a second heat exchanger within the helium gas extraction flow duct, the second heat exchanger being closer to the vessel to contain liquid helium than the first heat exchanger, and the second duct carries the liquid helium from the fluid outlet of the second stage of the second thermo-mechanical cooler through the second heat exchanger to the vessel to contain liquid helium.

3. The apparatus as claimed in claim 1 also comprising an intermediate temperature heat shield arranged to be cooled by the first stage of the second thermo-mechanical cooler.

4. The apparatus as claimed in claim 1 comprising a thermal shield arranged to be cooled by the second stage of the second thermo-mechanical cooler.

5. The apparatus as claimed in claim 1 comprising an operating-temperature thermal shield in thermal contact with the vessel to contain liquid helium.

6. The apparatus as claimed in claim 1 wherein a specimen to be cooled down is located in a chamber that is in thermal contact with the vessel to contain liquid helium.

7. The apparatus as claimed in claim 6 wherein the vessel to contain liquid helium has a base plate comprising a metal base layer and an upper layer of porous metal, each metal being a-geed thermal conductor.

8. The apparatus as claimed in claim 1 wherein the helium gas extraction flow duct has successive portions with different orientations so there is no unobstructed straight path between the vessel to contain liquid helium and a portion of the gas flow duct outside the enclosure.

9. The apparatus as claimed in claim 1 comprising baffles within a portion of the helium gas extraction flow duct to carry gas outside of the enclosure, to suppress radiant heat transfer without impeding gas flow.

10. The apparatus as claimed in claim 1 wherein the first heat exchanger defines part of the helium gas extraction flow duct.

11. The apparatus as claimed in claim 1 wherein the apparatus incorporates a specimen insertion tube, the tube extending to the outside of the enclosure, within which a specimen is supported.

12. The apparatus as claimed in claim 11 wherein the vessel to contain liquid helium surrounds the specimen insertion tube.

13. The apparatus as claimed in claim 12 wherein the helium gas extraction flow duct through which helium gas is extracted is also annular for at least part of the length of the helium gas extraction flow duct, and surrounds the specimen insertion tube.

14. The apparatus as claimed in claim 12 wherein the vessel to contain liquid helium and the first heat exchanger are each of annular form surrounding the specimen insertion tube, and are each in thermal contact with the specimen insertion tube, and are spaced apart along the length of the specimen insertion tube.

15. The apparatus as claimed in claim 1 wherein the first thermo-mechanical cooler is a single-stage cooler.

* * * * *